US010008186B2

(12) United States Patent
Kinney

(10) Patent No.: US 10,008,186 B2
(45) Date of Patent: Jun. 26, 2018

(54) SELECTABLE STRING COMBINATION CAPO

(71) Applicant: Michael Kinney, Noblesville, IN (US)

(72) Inventor: Michael Kinney, Noblesville, IN (US)

( * ) Notice: Subject to any disclaimer, the term of this patent is extended or adjusted under 35 U.S.C. 154(b) by 29 days.

(21) Appl. No.: 15/268,265

(22) Filed: Sep. 16, 2016

(65) Prior Publication Data

US 2017/0103736 A1 Apr. 13, 2017

Related U.S. Application Data

(60) Provisional application No. 62/219,193, filed on Sep. 16, 2015.

(51) Int. Cl.
*G10D 3/04* (2006.01)

(52) U.S. Cl.
CPC ..... *G10D 3/043* (2013.01)

(58) Field of Classification Search
CPC ..... G10D 3/043; G10D 3/08
See application file for complete search history.

(56) References Cited

U.S. PATENT DOCUMENTS 3,680,427 A * 8/1972 Valentino ..... G10D 3/043 84/318
3,776,088 A 12/1973 Jones
3,818,793 A 6/1974 Round
3,915,051 A 10/1975 Kincaid
3,995,523 A 12/1976 Clarke
4,030,400 A 6/1977 Del Castillo
4,183,279 A 1/1980 Shabram, Jr.
4,334,457 A 6/1982 Spoonts, III
4,926,732 A 5/1990 Collins et al.
5,623,110 A * 4/1997 Hoglund ..... G10D 3/043 84/318
6,723,905 B2 4/2004 Gillis
D533,211 S 12/2006 Kyser
7,557,285 B2 * 7/2009 Ward ..... G10D 3/043 84/315
7,563,969 B2 7/2009 Einhom et al.
8,642,863 B2 2/2014 Del Priore et al.
D717,367 S 11/2014 Kyser
2007/0227334 A1 10/2007 Ward
2012/0036978 A1 2/2012 Del Priore et al.

* cited by examiner

*Primary Examiner* — Kimberly Lockett
(74) *Attorney, Agent, or Firm* — Maginot, Moore & Beck LLP

(57) ABSTRACT

In accordance with one exemplary embodiment of the disclosure, a capo configured for use with a stringed instrument includes a frame, a mounting member, and a plurality of individually selectable toggle members. The mounting member is connected to the frame and configured to secure the frame to the musical instrument. The plurality of individually selectable toggle members are retained by the frame. A plurality of feet are provided on the toggle members, and the feet have differing widths.

20 Claims, 13 Drawing Sheets

SELECTABLE STRING COMBINATION CAPO

CROSS-REFERENCE TO RELATED APPLICATIONS

This application claims priority from U.S. provisional patent application No. 62/219,193, filed Sep. 16, 2015, the entire contents of which are incorporated herein by reference.

FIELD

This document relates to the field of musical instruments and, particularly to a capo for use with a stringed instrument.

BACKGROUND

A capo is a device used on the neck of a stringed (typically fretted) instrument to shorten the playable length of the strings, hence raising the pitch. The conventional capo applies pressure to all of the strings on any given fret of a musical instrument. In this way, novice and expert guitarists can easily change the key of any song while using the same chord finger positions above and relative to the capo. Capos are commonly used with any of various types of stringed instruments, including guitars, mandolins, and banjos. Some capo designs are configured for use with any of various different types of instruments, while other capo designs are specifically configured for use with a particular instrument.

There are various capo designs, each of which offers unique advantages over other capos. Example capo designs include the spring-clamp capo, the screw-on capo, the roller capo, and the wrap spring clutch capo, as well as numerous other cap designs. Certain capos are configured to apply pressure to all the strings of a musical instrument. These capos are sometimes referred to as "full capos." Other capos are configured to apply pressure to only some of the strings on any given fret of a musical instrument, thus enabling limited open-string tuning possibilities. These capos are typically referred to as "partial capos."

While partial capos provide several advantages, conventional partial capo designs have several limitations. Many partial capo designs are configured to apply pressure to only a limited number of strings. These partial capo designs do not allow the user to apply pressure to either (i) any combination of strings selected by the user, or alternatively (ii) all of the strings of the musical instrument. Additionally, conventional partial capo deigns are clumsy and require extra time and effort to fasten the capo to the fretboard. Moreover, conventional partial capo designs are often difficult to properly align with the compressing members properly positioned relative to the strings of the musical instrument, and are not quickly and easily moveable between the frets of the guitar or other stringed instrument. When the compressing members are not properly positioned relative to the strings, the capo will not apply the proper pressure to the appropriate strings, and the desired sound from the musical instrument will not be achieved.

Accordingly, it would be advantageous to provide a capo that can be used to selectively apply pressure to either a limited number of strings as desired by the user, or alternatively, all of the strings of the musical instrument. It would also be advantageous if such capo could be quickly and easily fastened to the fretboard with all the compressing members properly positioned relative to the strings of the musical instrument. Furthermore, it would also be advantageous if the capo could be quickly and easily moved between the frets of the musical instrument.

SUMMARY

In accordance with one exemplary embodiment of the disclosure, a capo configured for use with a stringed instrument includes a frame, a mounting member, and a plurality of individually selectable toggle members. The mounting member is connected to the frame and configured to secure the frame to the musical instrument. The plurality of individually selectable toggle members are retained by the frame. A plurality of feet are provided on the toggle members, and the feet have differing widths.

Pursuant to another exemplary embodiment of the disclosure, there is provided a capo comprising a frame, and a plurality of individually selectable toggle members retained by the frame. The capo further comprises a plurality of feet provided on the toggle members. Each foot is separated from an adjacent foot by a distance in a lateral direction. Each of the feet is also fixed relative to one another in the lateral direction. Additionally, the distance between two first adjacent feet is different than a distance between two second adjacent feet.

In accordance with yet another exemplary embodiment of the disclosure, there is provided a capo configured for use with a stringed instrument including a plurality of strings. The capo comprises a block including a plurality of holes and a plurality of plungers retained in the holes in the block. Each plunger includes a head end and a foot end. The head end is designed and dimensioned to engage a human fingertip, and the foot end is configured to engage one of the plurality of strings of the stringed instrument. Each of the plungers is fixed in a lateral direction relative to an adjacent plunger, and each plunger is selectively moveable in an engagement direction between a retracted position and a depressed position.

The above described features and advantages, as well as others, will become more readily apparent to those of ordinary skill in the art by reference to the following detailed description and accompanying drawings. While it would be desirable to provide a capo that provides one or more of the above-mentioned or other advantageous features, the teachings disclosed herein extend to those embodiments which fall within the scope of the appended claims, regardless of whether they accomplish one or more of the above-mentioned advantages.

DESCRIPTION

Figure 1:
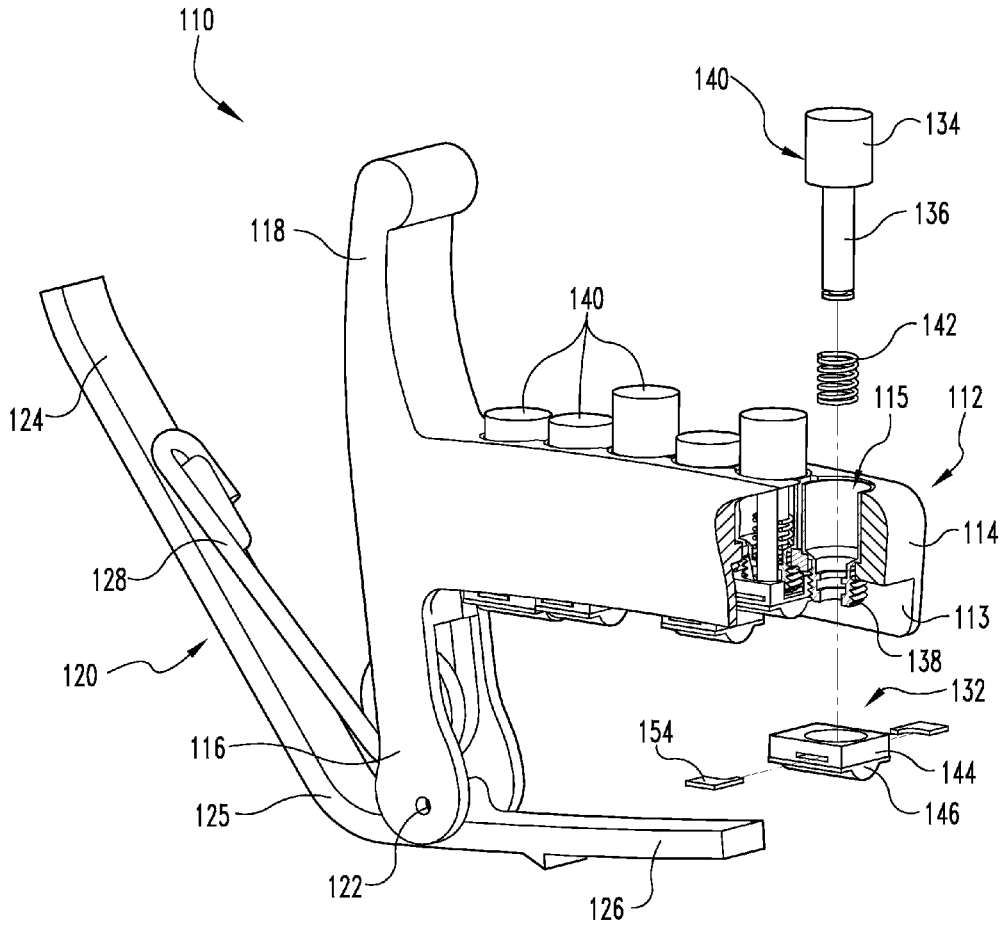
FIG. 1 shows a partial cutaway upper perspective view of on embodiment of a selectable string combination capo, including an exploded view of a toggle member of the selectable string capo.

With reference to FIGS. 1-4 a first embodiment of a partial capo 110 with selectable string combination functionality is shown. The capo 110 includes a frame 112, a lever 120 coupled to the frame 112, and a plurality of individually selectable toggle members 140 retained within the frame 112. Feet 146 are provided on the toggle members 140. The toggle members 140 are each selectively moveable between an engaged position and a retracted position.

The frame 112 of the capo 110 includes a retainer block 114, two hinge arms 116, and a handle 118. The retainer block 114 (which may also be referred to as a "bar" or an "upper arm") is generally shaped as a rectangular prism that is substantially solid but includes a plurality of holes 115 that extend through the retainer block 114 from the top surface to the bottom surface. Each hole 115 (which may also be referred to herein as a "cavity") is configured to receive one of the toggle members 140, as explained in further detail below. A skirt 113 extends around the lower perimeter of the retainer block 114, and generally extends the retainer block 114 downward past the bottom edge of the holes 115 in the retainer block 114. Accordingly, a void in the retainer block 114 is formed between the bottom edges of the holes 115 and the bottom edges of the skirt 113. This void formed by the skirt 113 provides a port in the bottom of the retainer block that is configured to receive the foot assembly 132 of each toggle member 140 when in the retracted position, as explained in further detail below.

Figure 2:
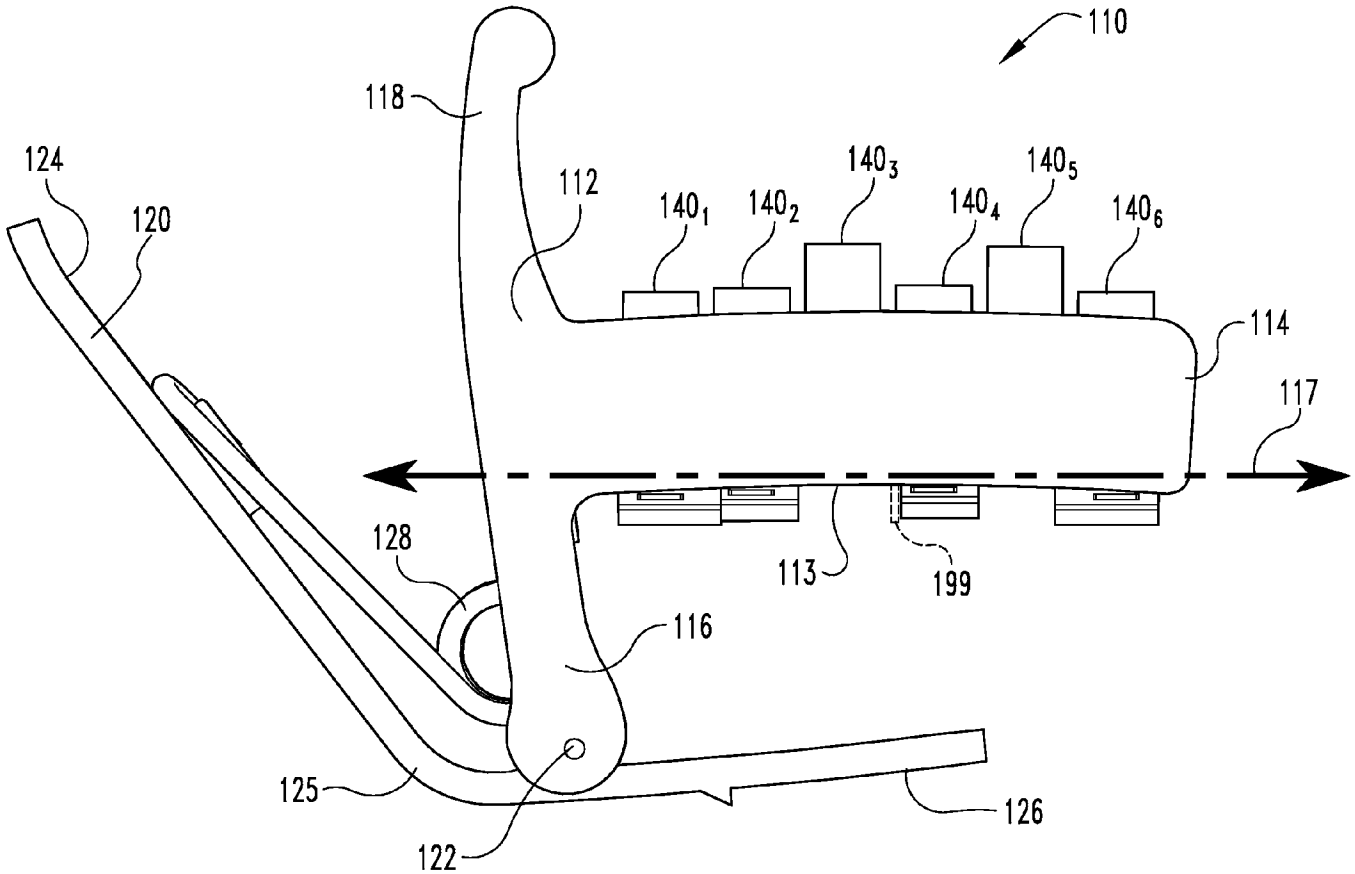
FIG. 2 shows a side view of the capo of FIG. 1.
Figure 3:
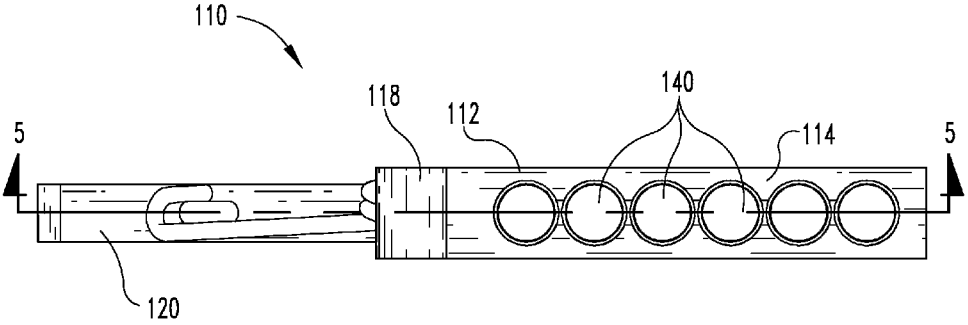
FIG. 3 shows a top view of the capo of FIG. 1.
Figure 4:
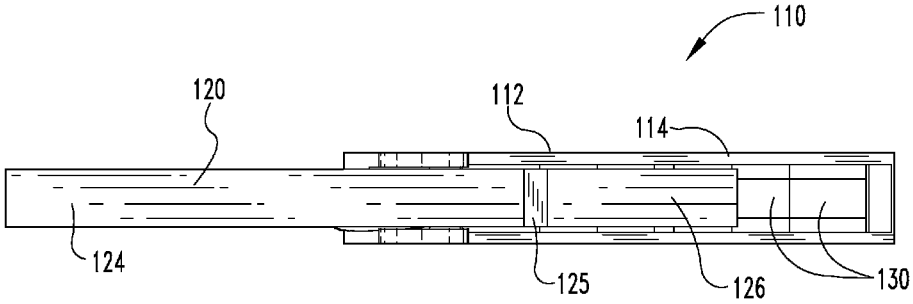
FIG. 4 shows a bottom view of the capo of FIG. 1.
Figure 8:
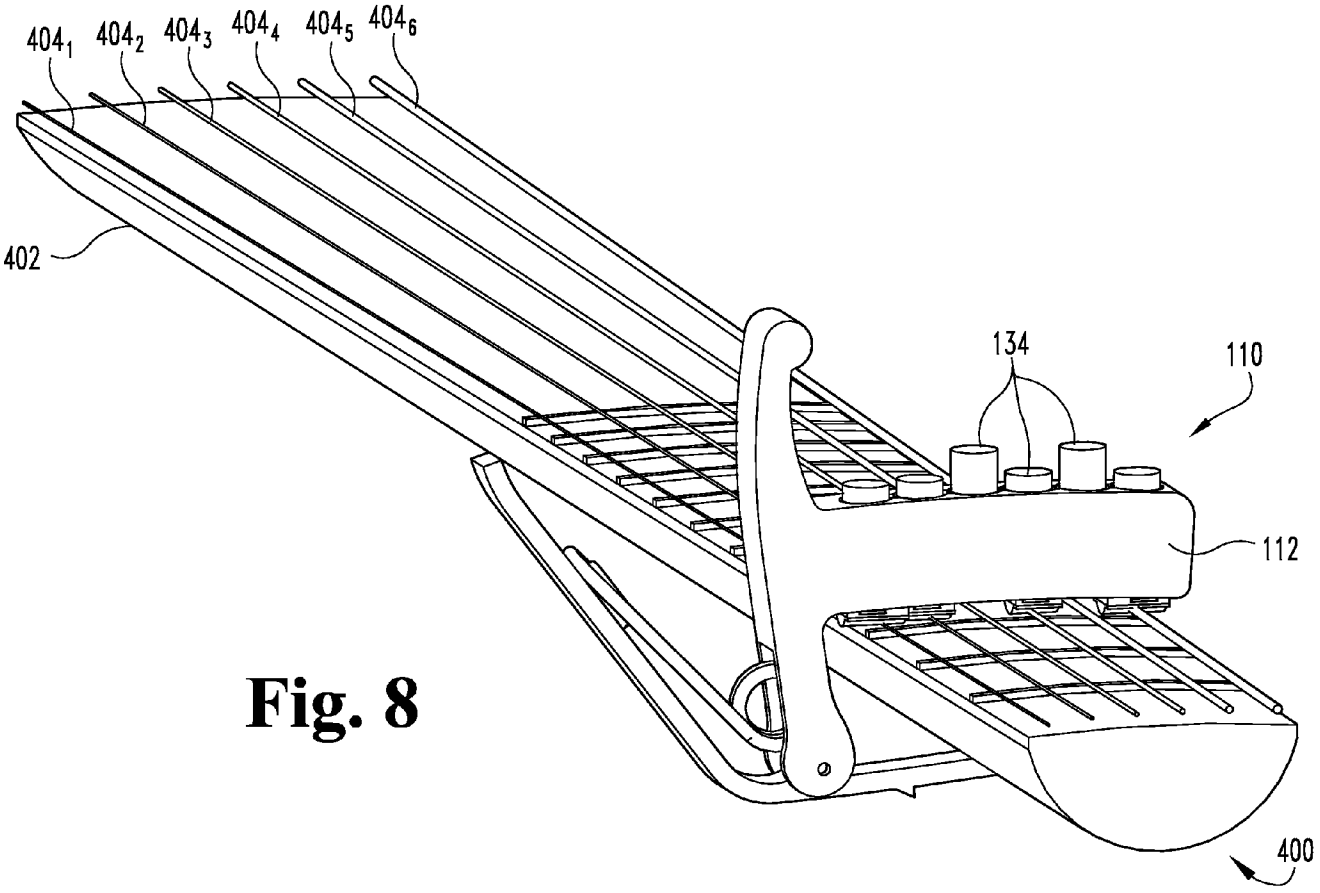
FIG. 8 shows a perspective view of the capo of FIG. 1 positioned on a guitar neck.

As best shown in FIG. 2, the retainer block 114, including the skirt 113, has a slight curvature designed to complement a similar curvature on a fret board of a stringed instrument (this slight curvature in the fret board can also be seen in FIG. 8, which shows a side view of the capo 110 clamped on the neck of a guitar). Accordingly, as noted by dotted line 117 in FIG. 2, the bottom edge of the skirt 113 is slightly below the dotted line 117 near the lateral toggle members $\mathbf{140}_1$ and $\mathbf{140}_6$, while the bottom edge of the skirt 113 touches the dotted line 117 near the medial toggle members $\mathbf{140}_3$ and 1404. Because of the slightly curved retainer block 114, the toggle members 140 retained in the holes 115 include lateral toggle members $\mathbf{140}_1$ and $\mathbf{140}_6$ that are slightly offset from the medial toggle members $\mathbf{140}_3$ and $\mathbf{140}_4$ in the direction of depression of the toggle members (i.e., a direction perpendicular to axis 117 of FIG. 2). In other words, the toggle members $\mathbf{140}_1$ and $\mathbf{140}_6$ are slightly lower than the medial toggle members $\mathbf{140}_3$ and $\mathbf{140}_4$ on the retainer block 114.

The hinge arms 116 of the frame 112 extend generally downward from the retainer block 114 and are substantially perpendicular to the retainer block 114. The hinge arms 116 are substantially parallel with a void provided between the two hinge arms 116. This void is configured to receive the lever 120 as well as the spring 128, which may be, for example, a helical torsion spring. A post or other protuberance may be provided on the interior surface of the two hinge arms 116 to retain the spring 128 in place between the two hinge arms 116. Each hinge arm 116 includes an end knob with a small hole formed in the middle of the end knob. The small hole is configured to receive a pivot pin 122 and provides a pivot point for the lever 120, as explained in further detail below.

The handle 118 of the frame 112 extends generally upward from the retainer block 114, directly opposite the hinge arms 116. The handle 118 is substantially solid from side-to-side to provide a solid feel for the frame. However, the handle 118 may include a relatively small rear cavity that is configured to engage a leg of the spring 128. The top of the handle 118 curves slightly back in the direction of the retainer block 114 and terminates in an end knob. The handle 118 is dimensioned to allow a user to wrap his or her fingers around the handle 118 or receive the knob of the handle 118 within the palm of his or her hand. The knob of the handle 118 prevents the handle from slipping within the hand of the user.

With continued reference to FIGS. 1-4, the lever 120 of the capo 110 includes a side arm 124 and a lower arm 126. The lever 120 is generally shaped as a bent rectangular bar with an elbow 125 positioned between the side arm 124 and the lower arm 126. The side arm 124 is an elongated portion that extends from one side of the elbow 125 and terminates in a free end. The length of the side arm 124 is similar to the combined length of the hinge arm 116 and the handle 118 of the frame 112. The side arm 124 includes a generally flat interior surface with a protuberance that is configured to engage another leg of the spring 128.

The lower arm 126 extends from the opposite side of the elbow 125 from the side arm 124 and also terminates in a free end. The length of the lower arm 126 is generally shorter than the length of the retainer block 114 (i.e., the lateral length as defined along axis 117 of FIG. 2). The lower arm 124 includes a flat interior surface that is configured to engage the neck of the stringed instrument. In at least one embodiment, a cushion pad, sleeve or other cushioning member may be provided on the lower arm 126 to avoid scratching the neck when the capo 110 is positioned on a stringed instrument. The cushioning member may be comprised of any of various materials such as felt, cotton, rubber, thermoplastic, or any of various other relatively soft and pliable materials A hole is formed in the lever 120 near the elbow. The pivot pin 122 extends through the hole and is configured to couples the lever 120 to the frame 112. The lever 120 is configured to pivot relative to the frame 112 at the pivot pin 122. The spring 128 biases the side arm of the lever 120 away from the handle 118 of the frame 112, and therefore also biases the lower arm 126 of the lever 120 toward the retainer block 114. Accordingly, the lever 120 provides a mounting mechanism that allows the frame 112 to be mounted to a guitar. In particular, when used in association with the frame 112, the lever 120 provides a clamp with the lower arm 126 and the retainer block 114 providing the clamping surfaces, and the handle 118 and the side arm 124 provide the actuators for the clamp. When a user applies a force to the side arm 124 that moves the side arm 124 toward the handle 118, the lower arm 126 moves away from the retainer block 114, thus allowing the neck of a guitar or other musical instrument to be inserted between the retainer block 114 and the lower arm. When the user removes the force, the spring 128 moves the side arm 124 away from the handle and moves the lower arm 126 toward the retainer block 114. As a result, the lower arm 126 and retainer block 114 clamp down on the neck of the musical instrument inserted therebetween. While the lever 120 has been described herein as providing a mounting member in the form of a clamp, it will be recognized that in alternative embodiments any of various mounting members may be used to secure the frame to the neck, and the mounting member need not include a lever or provide a clamp.

The frame 112 and the lever 120 are generally formed from relatively strong and rigid materials such as stainless steel or aluminum. However, the frame 112 and the lever may be comprised of any of various materials, including metals with a relatively high tensile strength such as steel, titanium, or any of various other metals or metal alloys. Furthermore, in at least one embodiment, the frame 112 and lever may be formed of a relatively strong and rigid polymer material, such as a PVC or other polymer material.

Figure 5:
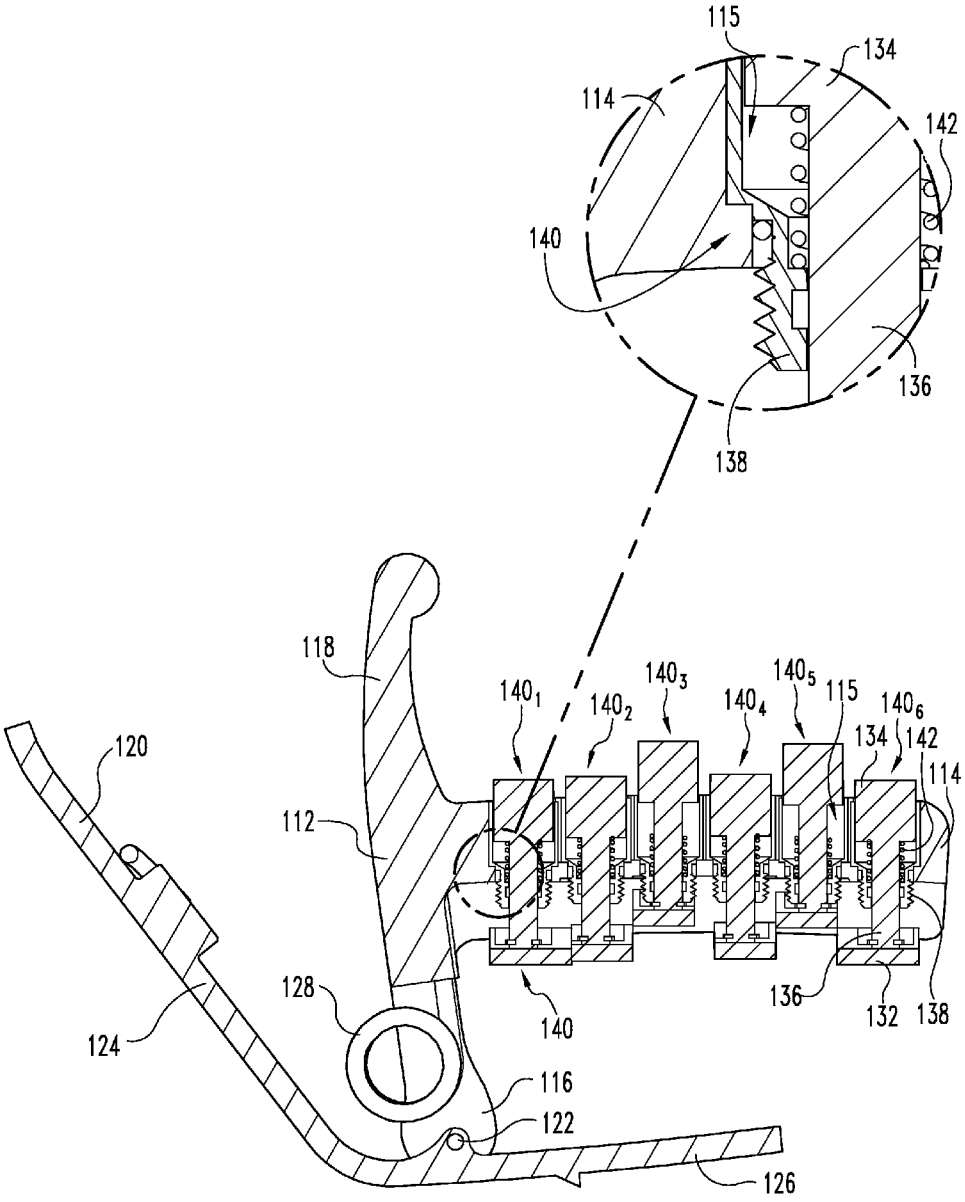
FIG. 5 shows a cross-sectional side view of the capo of FIG. 1.

With reference now to FIGS. 1 and 5, the toggle members 140 of the capo 110 are held within the holes 115 in the retainer block 114. The holes are equally spaced apart within the retainer block 114. While six toggle members $\mathbf{140}_1$-$\mathbf{140}_6$ are shown in the disclosed embodiment, it will be recognized that the capo 110 may include any number of toggle members 140 in associated holes 115 of the retainer block 114, such as four toggle members or eight toggle members. Each toggle member 140 is configured to move within one of the holes 115 in an axial direction defined by the hole 115 (this axial direction being generally perpendicular to the lateral direction illustrated by the axis 117 of FIG. 2). In particular, each toggle member is configured to move between a disengaged position (also referred to herein as a "retracted" position) and an engaged position. In FIG. 5, toggle members $\mathbf{140}_1$, $\mathbf{140}_2$, $\mathbf{140}_4$ and $\mathbf{140}_6$ are shown in the engaged position (which is a downward position in the orientation of FIG. 5), and toggle members $\mathbf{140}_3$ and $\mathbf{140}_5$ are shown in the disengaged position (which is an upward position in the orientation of FIG. 5). While the toggle members 140 are configured to move between the engaged and disengaged positions, it will be recognized that the toggle members 140 are fixed relative to one another in the lateral direction as a result of their mounting within the holes 115 of the retainer block 114.

As shown in FIGS. 1 and 5, each toggle member 140 includes a foot assembly 132, a pushbutton 134, and a plunger 136 (and may also be referred to herein as a "toggle assembly"). The pushbutton 134 provides a surface for the user to press against in order to toggle the associated plunger 136 and foot assembly 132 between the engaged position and the disengaged position. Each plunger 136 (which may also be referred to as a "button post") is an elongated post member that extends within one of the holes 115 of the retainer block 114 and connects the pushbutton 134 and the foot assembly 132. The pushbuttons 134 are all the same size and are each designed and dimensioned to engage a human fingertip. Because the holes 115 are equally spaced within the retainer block 114, the pushbuttons 134 are also equally spaced across the top of the retainer block 114. In the disclosed embodiment, the plunger 136 and the pushbutton 134 are provided as a single integrally formed component, such as a molded metal or polymer component. However, in other embodiments, the pushbutton 134 and the plunger 136 may be separate components connected together by an adhesive, fastener or other connector.

A mounting nut 138 surrounds the plunger 136 and allows the plunger 136 to slide therethrough in an axial direction, but prevents the pushbutton 134 from sliding therethrough. In this manner, the mounting nut 138 retains the toggle member 140 within the hole 115 of the retainer block 114. The mounting nut 138 may include a threaded surface that engages a complementary threaded surface in the retainer block 114. A retainer pin 145 may also be positioned between the mounting nut 138 and the retainer block 114 to assist in holding the mounting nut 138 in a fixed position within the retainer block 114, while also preventing the plunger 136 from moving past a desired position.

With continued reference to FIG. 5, a coil spring 142 is positioned between a top surface of the mounting nut 138 and a shoulder formed by the pushbutton 134 and the plunger 136. Because the mounting nut 138 is generally locked in position in the hole 115 of the retainer block 114, the spring 142 biases the pushbutton 134 and plunger 136 toward the disengaged position. The foot assembly 132 cannot pass through the mounting nut 138, and this prevents the spring 142 from forcing the toggle member 140 out of the retainer block 114.

A locking mechanism is also included with the retainer block 114 and toggle member 140 that allows the toggle member 140 to lock in the engaged position within the retainer block 114. This locking mechanism may be provided in any of various configurations and allows the user to move the toggle member 140 between the engaged position and the disengaged position (i.e., the retracted position), and vice-versa, with a simple press of the pushbutton 134. This locking mechanism may be provided in any of various forms, such as those locking mechanisms that are commonly used with ball point pens. In such an embodiment, each locking mechanism is configured to place the associated toggle member 140 in the engaged position when a first axial force is applied to the pushbutton 134 and associated plunger 136 in a direction toward the lower arm 126, and such axial force is sufficient to force the toggle member 140 to a threshold position (e.g., a position where the toggle member is past the engaged position). Additionally, such locking mechanism is configured to release the toggle member 140 from the engaged position when a second axial force is applied to the pushbutton 134 and the associated plunger 136 in the direction toward the lower arm 126 which again forces the plunger to the threshold position (e.g., again, a position where the toggle member is past the engaged position). In at least one embodiment, such a locking mechanism may include a rotatable cam (not shown) configured to be rotated when the pushbutton 134 and the plunger 136 are depressed within the hole 115 of the retainer block 114. The rotatable cam alternately engages and disengages a shoulder or other detent in the retainer block 114 to facilitate movement of the foot assembly between the engaged position wherein the spring 142 is more compressed and the disengaged position wherein the spring 142 is less compressed. Accordingly, the each plunger 136 and associated pushbutton 134 may be considered to be in a spring-loaded arrangement within the retainer block 114.

Figure 6:
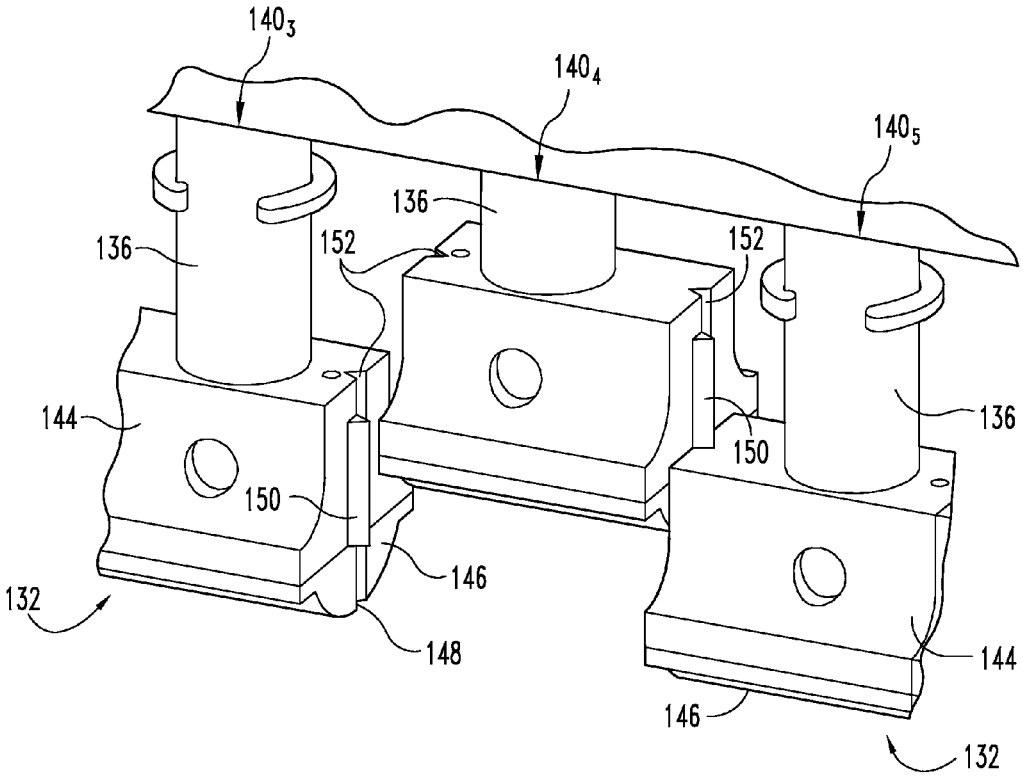
FIG. 6 shows an enlarged perspective view of three feet of another embodiment of a foot assembly for the capo of FIG. 1.

With particular reference now to FIGS. 1-5 and 6, embodiments of foot assemblies 132 are shown. The foot assemblies in FIG. 6 are the same as those shown in FIGS. 1-5, but the shape of the shoe 144 in FIG. 6 is slightly different from the shoe 144 in FIGS. 1-5. Also, in FIG. 6, three foot assemblies are shown in isolation mounted on the ends of three plungers 136. Each foot assembly 132 includes a shoe 144 and a foot 146. The term "foot" is used herein to refer to the end portion of the toggle assembly 140 that is configured to engage a string of an instrument. Similarly, the term "shoe" is used herein to refer to the portion of the toggle assembly that holds the foot. In the embodiment disclosed herein, the shoe 144 is a generally block-like member that is connected to the end of the plunger 136. In the embodiment of FIGS. 1-5, the end of the plunger 136 includes a circular end knob configured to fit within a recess 147 in the shoe 144. The shoe 144 may be connected to the plunger 136 using any of various means such as adhesives, welding, soldering, friction-fit, etc. However, in at least one embodiment, the shoe 144 is integrally formed with the plunger 136 such that the shoe 144 and connected plunger 136 form a single unitary part.

As best shown in FIGS. 5 and 6, the plungers 136 meet the shoes 144 at different locations. In particular, the plungers 136 on the lateral toggle members $\mathbf{140}_1$ and $\mathbf{140}_6$ connect to the associated shoes 144 on the lateral sides of the shoes at a first distance from the lateral edge of the shoes. Similarly, the plungers on the intermediate toggle members $\mathbf{140}_2$ and $\mathbf{140}_5$ connect to the associated shoes on the on the lateral sides of the shoes but at a second distance from the lateral edge of the shoes. However, the plungers on the medial toggle members $\mathbf{140}_3$ and $\mathbf{140}_4$ connect to the associated shoes on the on the medial sides of the shoes. In this manner, the capo 110 is configured with equally sized and equally shaped pushbuttons 134 along the top of the retainer block 114, but differently sized and spaced shoes 144 and feet 146 along the bottom of the retainer block 114. Advantages and operation of these differently sized and spaced shoes 144 and feet 146 is described in further detail below with reference to FIGS. 7 and 10A-10B.

The shoes 144 and feet 146 of each foot assembly 132 are configured with features to aid in stability of the foot assembly 132. As best shown in FIG. 6, the side of each shoe 144 includes a rail 150 and a groove 152. The rail 150 on one shoe 144 is configured to closely fit within the groove 152 in an adjacent shoe. This arrangement results in adjacent shoes 144 and associated feet 146 that are slideably interlocked. In particular, a first shoe is permitted to move in an axial direction between the retracted and engaged positions, as the rail 150 of the first shoe slides within the groove 152 of a second shoe (i.e., in an upward or downward direction in the orientation of FIG. 6). However, the first shoe is not permitted to move in a direction perpendicular direction perpendicular to the axial direction and the lateral direction (i.e., a direction outward from the page in FIG. 6) because the rail 150 on the first shoe is retained within the groove on the second shoe. This slideable interlocking arrangement between adjacent shoes 144 (and the associated foot 146) provides significant stability for the toggle members 140 when the capo 110 is in use.

In addition to the rail and groove arrangement of FIG. 6, the shoe 144 in the embodiment of FIGS. 1-5 also includes shims 154 on the front and rear sides of the shoe 144. These shims 154 (which may also be referred to as "plates") are comprised of a generally low-friction, but flexible and resilient material, such as an elastomer, and are configured to fit within slots in the shoe 144. The shims 154 engage the skirt 113 of the retainer block 114 when the associated toggle member 140 is moved to the retracted position. Because of this engagement of the shims 154 with the skirt 113, the shoes 144 and feet 146 are prevented from rotating when the capo 110 is in use.

With continued reference to FIGS. 1-5 and 6, each foot 146 is a provided as a curved block member connected to the shoe 144. In the disclosed embodiment, each foot 146 is provided in the form of a pad. Each pad is substantially solid and is comprised of a resilient material such as a rubber or an elastomer. The foot 146 may be connected to the shoe 144 (which may also be referred to herein as a "pad base") using any of various means such as adhesives, welding, fasteners, or any of various other means. However, it will be recognized that in other embodiments, each foot 146 may be integrally formed with the associated shoe 144 and/or the plunger 136. Accordingly, in at least some embodiments, the feet 146 may be formed of the same material as the plungers 136 and may be provided as an end portions of each plunger.

In the embodiments of FIGS. 1-5 and 6, the foot 146 is generally provided as a semi-cylindrical block defined by a lateral axis on the capo 110. Each foot 146 includes a central vertex 148 that is directed toward the lower arm 126. In other words, the curves or line segments that define the vertex 148 intersect and point in the direction of the lower arm 126. In the orientation of FIG. 6, the vertex 148 of each foot 146 is defined by a ridgeline or line segment that extends in the lateral direction on the capo 110. This direction is substantially parallel with the elongation axis of the retainer block 114 and the lower arm 126. As will be described in further detail below, this arrangement with a laterally extending ridgeline as the vertex 148 of the foot 146 allows the foot 146 to engage a desired string at a number of different locations on the foot 146, thus allowing the capo 110 to remain operational when placed at any of a number of different locations on the neck of the stringed instrument.

Figure 7:
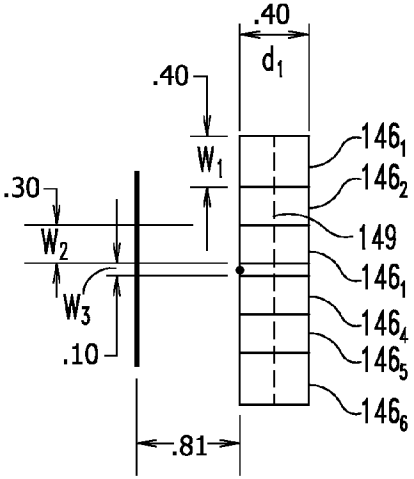
FIG. 7 is a diagram of the footprint of six laterally arranged feet of the capo of FIG. 1, including associated dimensions.

With reference now to FIG. 7, a plan view of the feet 146 is shown with the feet $\mathbf{146}_1$-$\mathbf{146}_6$ arranged in a lateral row as they would be in the engaged position on the retainer block 114. The dotted line 149 in FIG. 7 represents the location of the vertex 148 extending in a lateral direction across each foot 146. As noted previously, the feet 146 are stationary relative to one another in the lateral direction (i.e., the direction defined by the dotted line 149). The feet include two lateral feet $\mathbf{146}_1$ and $\mathbf{146}_6$, two intermediate feet $\mathbf{146}_2$ and $\mathbf{146}_5$, and two medial feet $\mathbf{146}_3$ and $\mathbf{146}_4$.

The dimensions of the feet $\mathbf{146}_1$-$\mathbf{146}_6$ are different. As shown in FIG. 7, the depth $d_1$ of each foot 146 is between 0.30 and 0.50 inches (wherein the depth $d_1$ is perpendicular to the lateral direction defined by dotted line 149), and particularly 0.40 inches in depth. However, the width of the feet 146 differs. In particular, the width of the lateral feet $\mathbf{146}_1$ and $\mathbf{146}_6$ is between 0.35 and 0.45 inches, and particularly 0.40 inches, as noted by dimension $w_1$ in FIG. 7. On the other hand, the width of the intermediate feet $\mathbf{146}_2$ and $\mathbf{146}_5$, as well as the medial feet $\mathbf{146}_3$ and $\mathbf{146}_4$ is between 0.25 and 0.35 inches, and particularly 0.30 inches, as noted by dimension $w_2$ in FIG. 7. Thus, it will be recognized that the four inner feet $\mathbf{146}_2$, $\mathbf{146}_3$, $\mathbf{146}_4$, and $\mathbf{146}_5$ have the same width, but the lateral feet $\mathbf{146}_1$ and $\mathbf{146}_6$ have different widths than the four inner feet. Accordingly, it will be recognized that although the pushbuttons 134 are all equidistant along the top of the retainer block 114, the feet 146 are not all equidistant along the bottom of the retainer block because of their varying width. As discussed in further detail below, this varying width of the feet 146 allows the capo to be used over a broader range of frets of a guitar or the neck of another stringed instrument.

With continued reference to FIG. 7, each foot 146 is separated from an adjacent foot 146 by a relatively small separation distance that is sufficient to allow sliding of each foot past the immediately adjacent feet (i.e., the feet 146 are configured to slide in the direction in and out of the page in FIG. 7). While this relatively small separation distance prevents rubbing of the feet 146 during sliding, the distance is sufficiently small that the feet 146 are stabilized by the adjacent feet and prevented from rotating. In the embodiment of FIG. 7, each foot is separated from the immediately adjacent feet by a range between 0.01 and 0.07 inches, and particularly 0.04 inches. Accordingly, the distance between adjacent feet $\mathbf{146}_1$ and $\mathbf{146}_2$ in FIG. 7 is 0.04 inches. Similarly, the distance between adjacent feet $\mathbf{146}_4$ and $\mathbf{146}_5$ is 0.04 inches.

While each foot 146 is separated from adjacent feet by the separation distance, the two medial feet $\mathbf{146}_3$ and $\mathbf{146}_4$ are separated by a gap $w_3$ that is greater than the separation distance between the other adjacent feet. In the embodiment of FIG. 7, the gap $w_3$ is 0.10 inches. This gap $w_3$ may serve a number of purposes. For example, the gap $w_3$ allows medial feet $\mathbf{146}_3$ and $\mathbf{146}_4$ to be more closely centered over strings 3 and 4 of the guitar over the greatest number of frets, as explained in further detail below. Additionally, the gap $w_3$ saves on the cost of material, since the feet in this area will not contact a string when positioned on any fret of the musical guitar. Alternatively, in at least one embodiment, the gap $w_3$ may be used to provide an additional support. For example, a dummy foot 199 (shown in phantom lines in FIG. 2 for illustration purposes only) could be positioned in the gap $w_3$. This dummy foot 199 could be a non-toggle foot that is always in the engaged position and configured to fit between the third and fourth strings (or other middle strings) when the capo 110 is coupled to a musical instrument. The dummy foot 199 could be comprised of a relatively stable but resilient material such as a firm rubber or a similar elastomer material. Such a dummy foot 199 is useful in stabilizing the capo relative to the centerline of the guitar neck, and preventing the capo from teetering from side-to-side when an imbalance occurs in the engaged toggle members 140 and/or when the guitar neck includes a greater curvature. Such a dummy foot 199 could also be equipped with a rail (similar to rail 150 on the shoes) that engages the medial feet $\mathbf{146}_3$ and $\mathbf{146}_4$ a greater distance as the feet extend downward in the engaged position, thus adding even more stability that further prevents the medial feet $\mathbf{146}_3$ and $\mathbf{146}_4$ from rotating.

Figure 9:
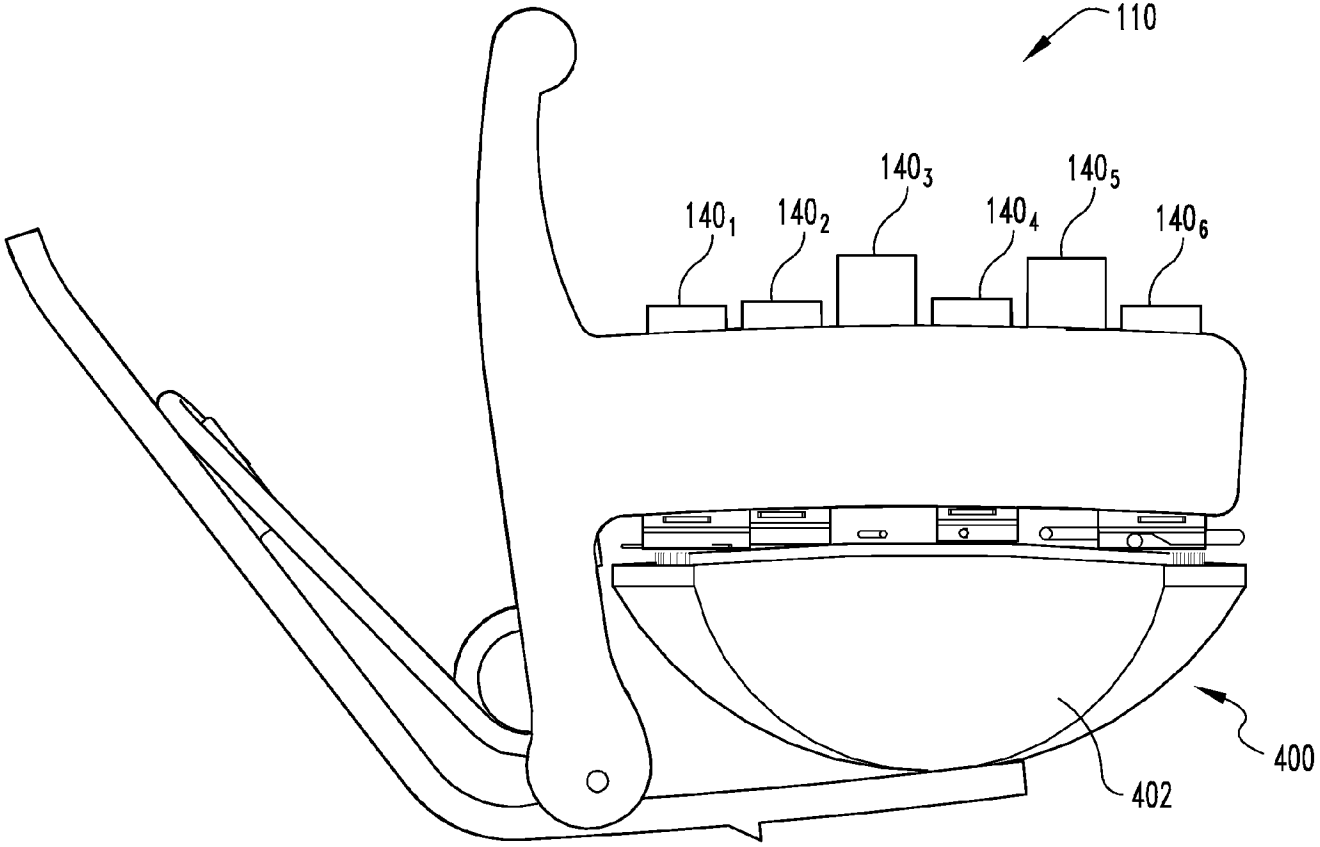
FIG. 9 shows a side view of the capo and guitar neck of FIG. 7.

With reference now to FIGS. 8 and 9, in operation, the capo 110 is configured for placement on the neck of a musical instrument. When the capo 110 is positioned on the neck of a stringed instrument, the foot 146 of each toggle member 140 is configured to engage a string of the instrument when the associated toggle member 140 is in the engaged position, and disengage the string when the associated toggle member 140 is in the retracted position. FIGS. 8 and 9 show the capo 110 clamped on the neck 402 of a guitar 400. In the embodiment of FIGS. 8 and 9, toggle members $\mathbf{140}_1$, $\mathbf{140}_2$, $\mathbf{140}_4$, and $\mathbf{140}_6$ are in the engaged position such that the feet associated with these toggle members engage the strings $\mathbf{404}_1$, $\mathbf{404}_2$, $\mathbf{404}_4$, and $\mathbf{404}_6$ of the guitar 400. Toggle members $\mathbf{140}_3$ and $\mathbf{140}_5$ are in the retracted position such that the feet 146 associated with these toggle members 140 do not engage the strings $\mathbf{404}_3$ and $\mathbf{404}_5$. However, as explained previously, a user may selectively press on the pushbutton 134 of any given toggle member 140 to change which strings of the guitar are engaged by the feet 146 of the capo 110.

Figure 10A:
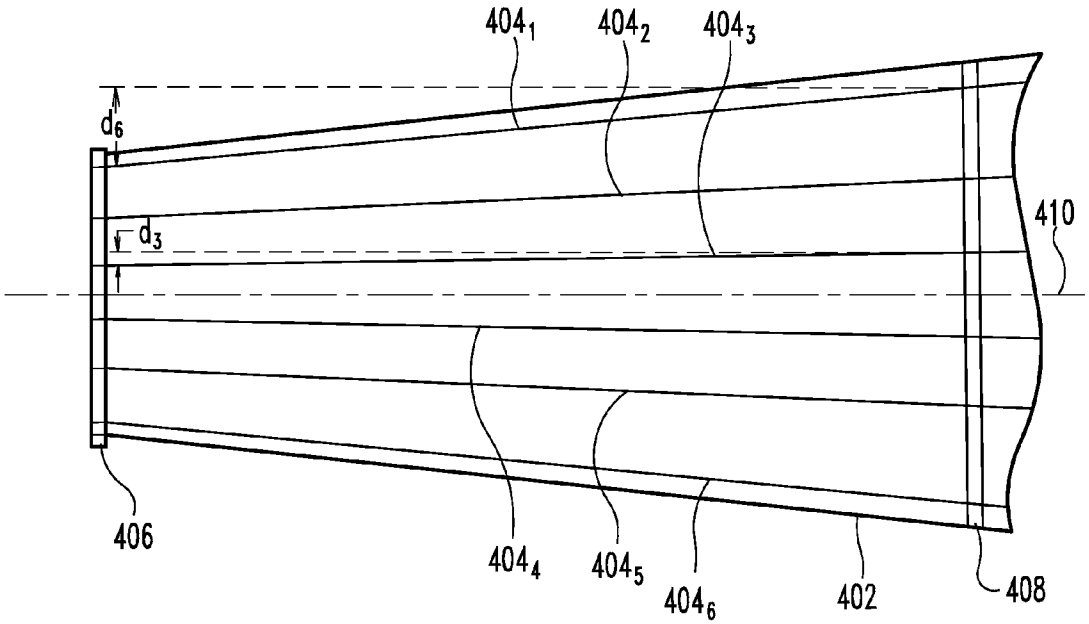
FIG. 10A is an exaggerated diagram of the strings of a guitar arranged on a neck of the guitar.

It will be recognized that the size and the spacing of the feet 146 of the capo allow the capo to be used over multiple frets of the musical instrument. To facilitate this understanding, FIG. 10A shows an exaggerated view of a guitar neck 402 with six strings 4041-4046 extending between the nut 406 and the bridge 408 of the guitar. The dotted line 410 shows an axial centerline of the neck 402. Strings $\mathbf{404}_1$-$\mathbf{404}_3$ are above the axial centerline and strings $\mathbf{404}_4$-$\mathbf{404}_6$ are below the axial centerline 410. The neck 402 is tapered moving from the bridge 408 to the nut 406 such that the strings of the guitar are slightly closer together at the nut than at the bridge. Because of this, any given position on the medial strings $\mathbf{404}_3$ and $\mathbf{404}_4$ relative to the axial centerline 410 changes only a small amount (i.e., an additional distance $d_3$) when moving from the nut 406 to the bridge 408. However, any given position on the lateral strings $\mathbf{404}_1$ and $\mathbf{404}_6$ relative to the axial centerline 410 changes by a significantly greater amount (i.e., an additional distance $d_1$) when moving from the nut 406 to the bridge 408.

With the configuration of the feet as shown in FIG. 7, the capo 110 is configured for use over a greater distance on the neck of a musical instrument. In particular, because the lateral feet $\mathbf{146}_1$ and $\mathbf{146}_6$ are wider than the medial feet $\mathbf{146}_3$ and $\mathbf{146}_4$, the capo 110 can compensate for the string variation represented in FIG. 10A. Additionally, the relatively large center gap $w_3$, allows the medial feet $\mathbf{146}_3$ and $\mathbf{146}_4$ to be more closely centered over strings 3 and 4 of the guitar over the greatest number of frets.

Figure 10B:
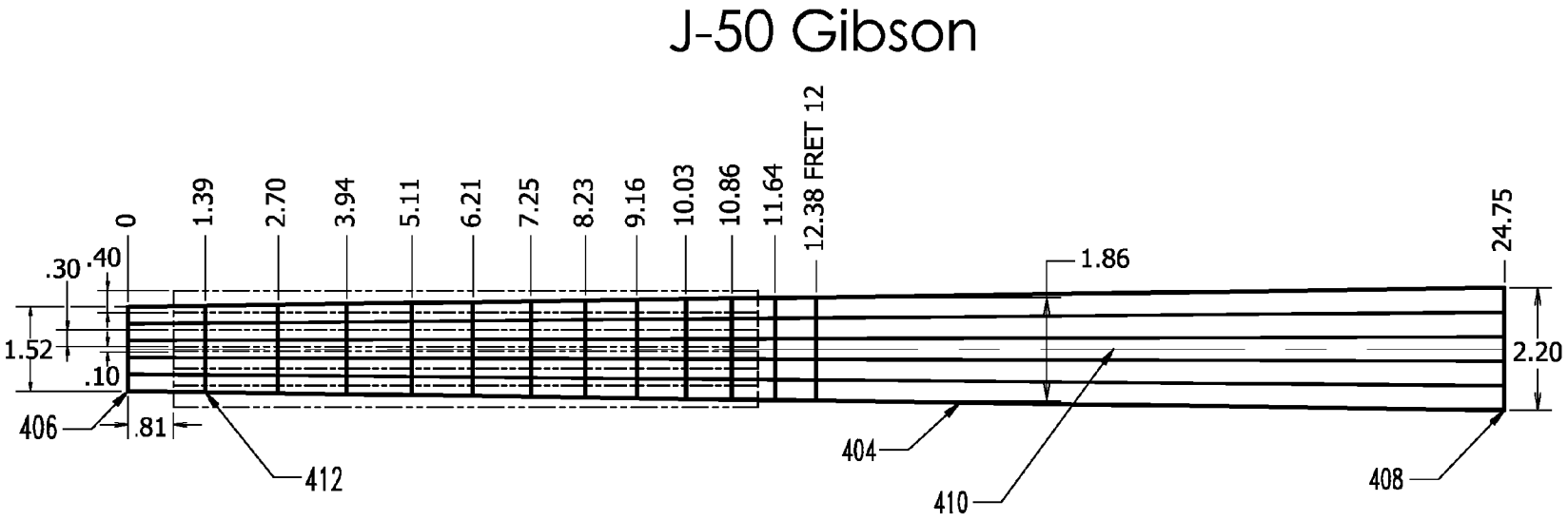
FIG. 10B is a diagram illustrating the range covered by the capo of FIG. 1 on a first guitar.
Figure 10C:
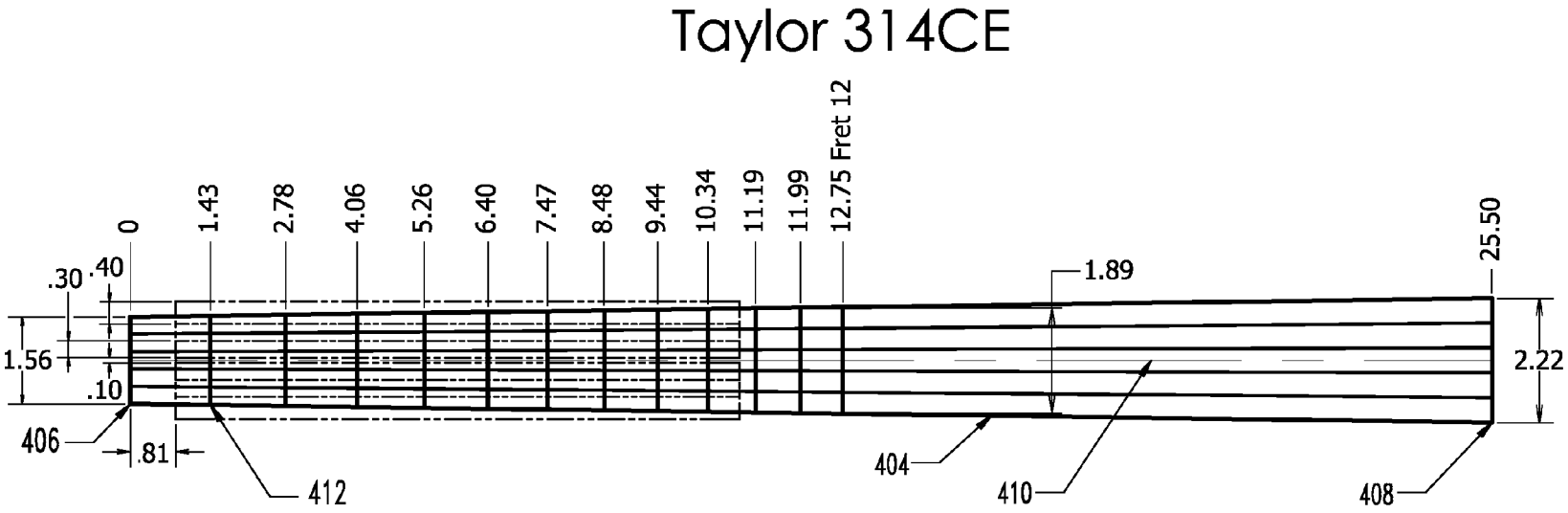
FIG. 10C is a diagram illustrating the range covered by the capo of FIG. 1 on a second guitar.

FIG. 10B and FIG. 10C show the strings 404 of two different guitar models with the capo foot configuration 470 shown in FIG. 7 extended to a range of positions across the necks of the guitars. As shown in these figures, the capo foot configuration 470 with feet of differing widths (i.e., the lateral feet wider than the medial feet and intermediate feet), along with a center gap between the medial feet, allows the feet 146 of the capo 110 to contact the strings at the appropriate locations over a large distance on the neck of the guitars. In particular, the capo 110 is designed and dimensioned to properly engage the strings on the guitars starting at fret 1 and extending to frets 9 and 10. Similar results are also recognized with other guitars, with the capo 110 configured for use across the first ten to eleven frets in many guitars. Thus, it will be recognized that the foot configuration 470 is designed such that the contact zone for the feet on the strings is increased across multiple frets. In other words, the foot configuration 470 allows the capo 110 to achieve maximum playability across multiple frets of the guitar (or other stringed instrument) while preventing neighboring feet 146 from interfering with neighboring strings on the guitar. Furthermore, the arrangement of the toggle members is such that the feet are designed to apply as much pressure as needed to the string to keep the string from buzzing, in tune, and prevent pulling.

Figure 11:
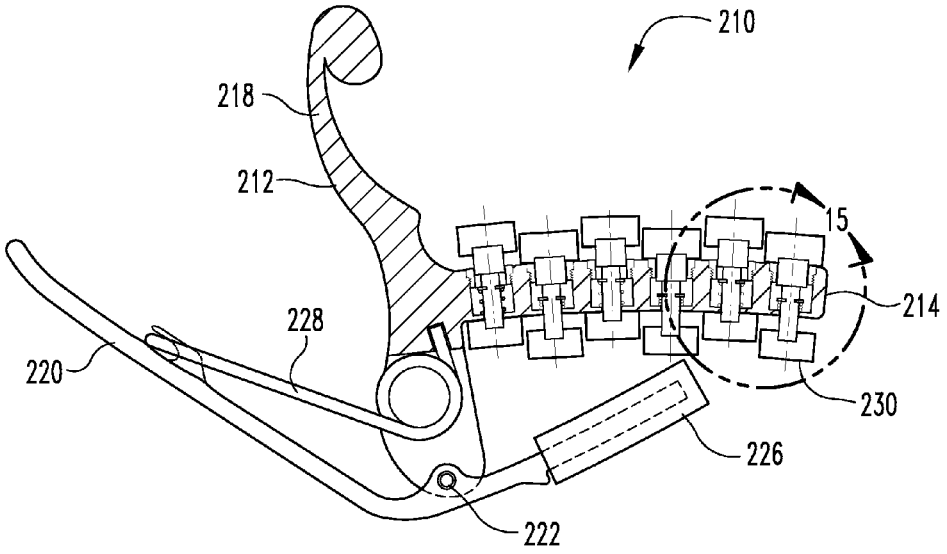
FIG. 11 shows a cross-sectional side view of another embodiment of a selectable string combination capo with a lower arm in a closed position.
Figure 12:
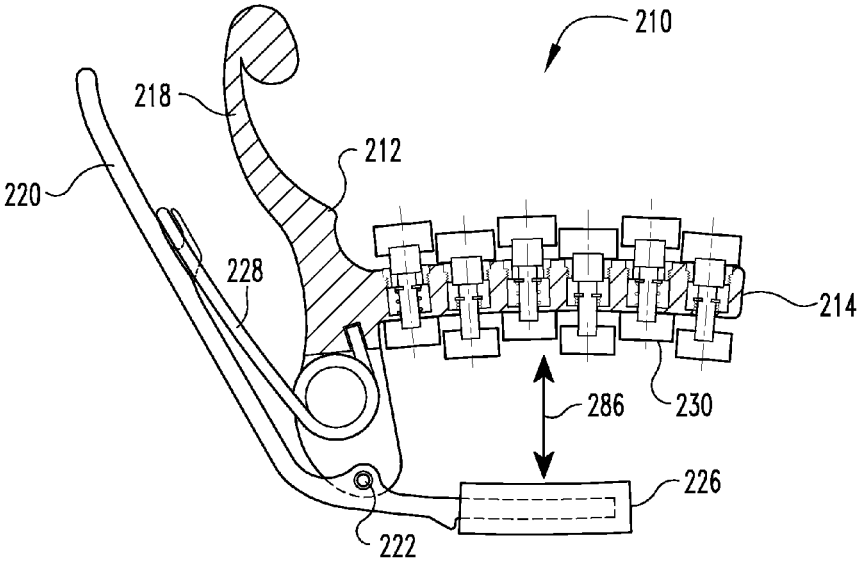
FIG. 12 shows a cross-sectional side view of the capo of FIG. 11 with the lower arm in an open position.

With reference now to the embodiment of FIGS. 11-12, a capo 210 is configured for use on a stringed instrument such as a guitar (not shown). The capo 210 is similar to the capo 110 shown in FIGS. 1-7, but includes several distinctions as noted below. As shown in FIGS. 11-12, the capo 210 includes a frame 212, a lever 220, and a plurality of spring-loaded, retractable feet 230. The frame 212 includes an upper arm 214, a handle 218 and a lever 220. The frame 212 is configured to clamp to the neck of the stringed instrument with the upper arm 214 extending across the strings on the front of the neck of the stringed instrument and the lower arm 226 engaging the rear side of the neck. The lever 220 includes the lower arm 226 which is pivotable about the pivot point 222. A spring 242 biases the lower arm 226 toward the upper arm 214, as shown in FIG. 11. However, when the lever 220 is moved toward the handle 218, the lower arm 226 is moved away from the upper arm 214, as shown in FIG. 12, providing a sufficient space for the neck of the guitar to be inserted between the upper arm 214 and the lower arm 226, as noted by arrow 286. When a guitar neck is placed in this space and the lever 220 is released, the spring 242 forces the lower arm 226 into contact with the rear side of the guitar neck. At the same time, this force draws the upper arm 214 toward the guitar neck such that one or more feet 230 contact the strings of the guitar.

Figure 15:
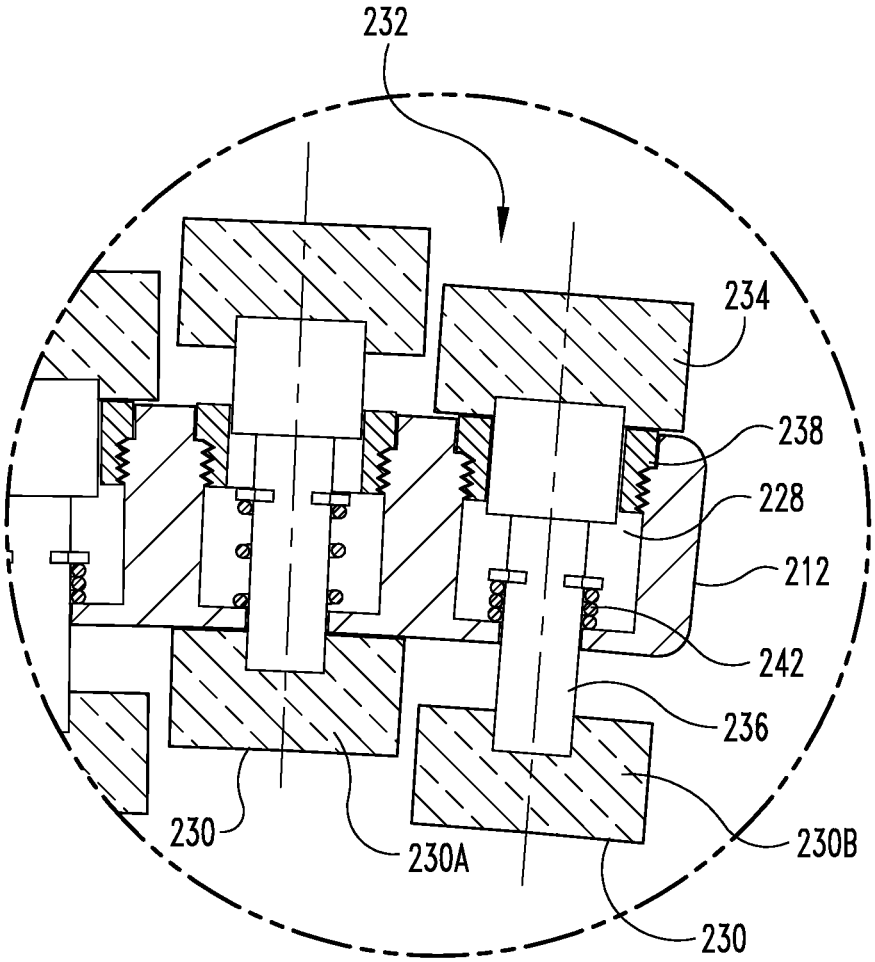
FIG. 15 shows an enlarged view of the feet of the capo of FIG. 11.

Six feet 230 are mounted on the upper arm 214 and are arranged laterally in a row. Unlike the embodiment of FIGS. 1-7, in the embodiment of FIGS. 11 and 12, each foot 230 has the same lateral width and all the feet 230 are separated from adjacent feet by the same distance. Each foot 230 is part of a foot assembly 232, and each of the six foot assemblies are mounted within a cavity 228 of the upper arm 214, as shown in further detail in FIG. 15. FIG. 15 shows a first foot 230A in a disengaged position, and a second foot 230B in an engaged position. Each foot assembly 232 includes an upper button 234, a plunger 236, a mounting nut 238, and a spring 242. The upper button 234 provides a surface for the user to press against to toggle the associated foot between the engaged position and the disengaged position. The plunger 236 extends between and connects the upper button 234 and the foot 230 and is configured to move in an axial direction within the cavity 228. The mounting nut 238 retains the foot assembly 232 within the cavity 228. The mounting nut may include a threaded surface that engages a complementary threaded surface in the cavity 228.

The spring 242 biases the upper button 234 and foot 230 in the disengaged position, as shown by foot 230A. In this position, the foot 230A is removed from the associated string of the guitar. However, when the upper button 234 is depressed, the foot is moved to the engaged position, as shown by foot 230B. In this position, the foot 230B engages the associated string of the guitar and forces the string against the fretboard. A retraction mechanism (not shown) is also included with the foot assembly 232. This retraction mechanism may be provided in any of various configurations and is configured to allow the user to toggle the upper button 234 and the associated foot 230 between the engaged position and the disengaged position (i.e., the retracted position), and vice-versa, with a simple press of the upper button 234. This retraction mechanism may be provided in any of various forms, such as retraction mechanisms as are commonly used with ball point pens. In at least one embodiment, such retraction mechanism may include a rotatable cam configured to be rotated when the upper button 234 and the plunger 236 are depressed. The rotatable cam alternately engages and disengages a shoulder or other detent in the upper arm 214 to facilitate movement of the foot assembly between the engaged position and the disengaged position.

Figure 13:
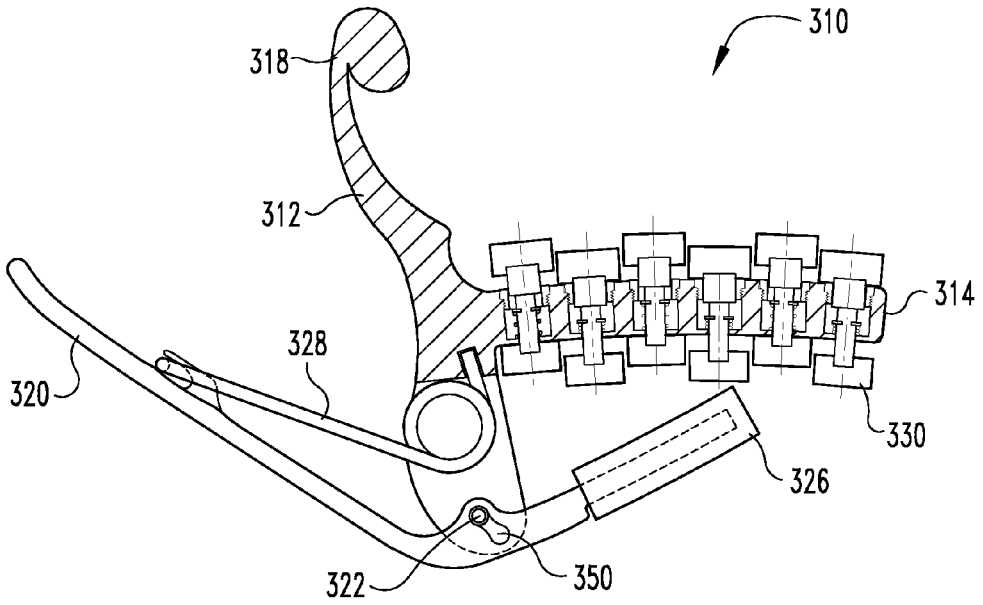
FIG. 13 shows a cross-sectional side view of another alternative embodiment of the selectable string combination capo including a slip joint and the lower arm in the closed position.
Figure 14:
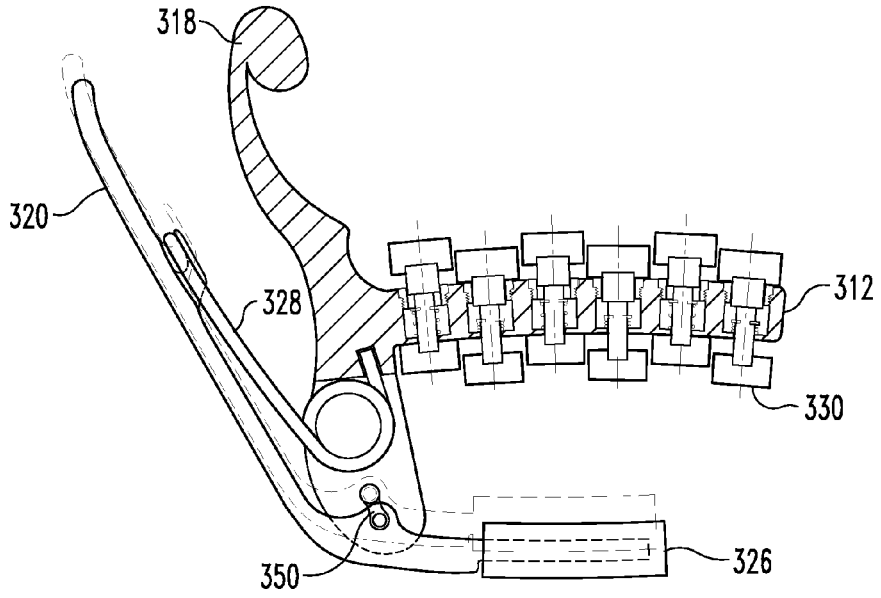
FIG. 14 shows a cross-sectional side view of the capo of FIG. 13 with the lower arm in an open position.

With reference now to FIGS. 13 and 14, yet another alternative embodiment of the capo 310 is shown. Similar to the embodiment of FIGS. 11-12, the capo 310 includes a frame 312, an upper arm 314, a handle 318, a lever 320, a lower arm 326, a biasing spring 328, and a plurality of feet 330. In this embodiment, the frame 312 of the capo 310 also includes a slip joint 350 at the pivot location 322 on the handle 318. This slip joint 350 is similar to an arrangement commonly provided with slip-joint pliers, and allows the capo to be used with stringed instruments having a larger neck. The dotted lines in FIG. 14 illustrate the position of the lower arm 326 when the slip joint 350 is in an inward position (and the distance between the upper arm 314 and the lower arm 326 is smaller), and the solid lines show the position of the lower arm 326 when the slip joint is in an outward position (and the distance between the upper arm 314 and the lower arm 326 is greater).

As noted above, the selectable string combination capo 110 (as well as embodiments 210 and 310) features selectable-string functionality. The multi-functional capo 110 provides at least two different functional applications. The first application allows for the clamping of the capo 110 to the guitar with a force applied to the rear side of the neck of the guitar and the front side of the neck of the guitar. This type of application may be used for sequential depression of strings against the fretboard of the guitar. The second application provides the ability to selectively depress a foot over a specific string, and thus pressing that string to the fretboard. The present invention efficiently combines both applications to allow for easier use for guitarists.

The capo 110 described herein (along with alternative embodiments of the capo 210 and 310) allows beginning and advanced guitarists to play new and interesting chords using similar chord shapes (finger positions) above and relative to the capo. The multi-functional capo 110 makes easy-to-play, one and two-finger chord shapes possible for beginning guitarists while providing advanced guitarists with new chord structures possibilities for experimentation and creative-improvisation. Songs that incorporate the use of the capo 110 may add Capo 1, Capo 2, Capo 3, etc. to the top of the music sheet, depending on which fret the capo is clamped. However, in at least one embodiment, music sheets designed for use with the capo 110 described herein may use a form of notating that identifies the fret number and string number(s) to be pressed. For example, if the capo 110 is clamped on the first fret with the feet 146 positioned over strings 2 (i.e., note A), 3 (i.e., note D) and 5 (i.e., note B) are depressed then the sheet music may read: "Capo 1.235". As another example, if the capo 10 is clamped on the third fret and the feet 146 over strings 1 (i.e., note E), 3 (i.e., note D) and 4 (i.e., note G) are depressed then the sheet music would read: "Capo 3.134". Accordingly, it will be recognized that a method of using a capo is also described herein, wherein a series of numbers describes the configuration of the capo for use with the song. While the series of numbers has been expressed herein as a decimal (e.g., "3.134"), it will be recognized that the series of numbers may also be expressed differently (e.g., "3:134", "3:1-3-4", "3-1-3-4", "3-1, 3, 4", etc.) Advantageously, common chord shapes that are traditionally used above and relative to a capo (or without a capo) can be used above and relative to the capo 110 described herein, while also producing new alternate-tunings, and more open-sounding chords.

In at least one embodiment, multiple capos 110 may be used on a single musical instrument, thus providing the opportunity to play chords that would not be possible without the use of the capos 110. For example a full capo could be used on fret 1, and a second capo 110 may be used on fret 4 of a guitar. This provides the opportunity to play notes between the second capo 110 and the bridge of the guitar, or alternatively, notes between the first capo and the second capo 110. Accordingly, the capo 110 described herein provides the opportunity to experiment with new chords that would not be possible without the capo. If a particular musical arrangement is designed for use with multiple capos, the sheet music may include specific instructions for placement of the capos. For example, the sheet music may include the following instructions for a first capo: "1, 2", wherein the "1" represents capo #1 (a full capo), and the "2" represents the second fret. Similarly, the sheet music may include the following instructions for a second capo: "2, 3.1256", wherein the "2" represents capo #2 (a partial capo such as capo 110), the "3" represents the third fret, and the "1256" represents feet 1, 2 ,5 and 6 in the depressed position engaging associated strings 1, 2, 5 and 6 on the guitar.

The foregoing detailed description of one or more exemplary embodiments of the selectable string combination capo has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A capo configured for use with a stringed instrument, the capo comprising:

a frame;

a mounting member connected to the frame and configured to secure the frame to the stringed instrument;

a plurality of individually selectable toggle members retained by the frame, each of the toggle members moveable between an engaged position and a retracted position;

a plurality of locking mechanisms retained in the frame, each locking mechanism associated with one of the toggle members, wherein each locking mechanism is configured to retain the associated toggle member in the engaged position when a first axial force on the toggle member toward the mounting member forces the toggle member to a threshold position, and wherein each locking mechanism is configured to release the associated toggle member from the engaged position when a second axial force on the toggle member in the direction of the mounting member forces the toggle member to the threshold position; and a plurality of feet provided on the toggle members, wherein the feet have differing widths.

2. The capo of claim 1 further comprising a spring configured to bias the mounting member relative to the frame, wherein the spring, the frame, and the mounting member form a clamp.

3. The capo of claim 1 wherein the toggle members are spring loaded plungers, each of the spring loaded plungers moveable between an engaged position and a retracted position.

4. The capo of claim 3 wherein the frame includes a curved block and the plungers are retained in holes in the curved block, the plungers including medial plungers and lateral plungers, wherein the medial plungers are offset from the lateral plungers.

5. A capo configured for use with a stringed instrument, the capo comprising:

a frame;

a mounting member connected to the frame and configured to secure the frame to the stringed instrument;

a plurality of individually selectable toggle members retained by the frame; and a plurality of feet provided on the toggle members, wherein the feet have differing widths and wherein each foot includes a vertex directed towards the mounting member.

6. The capo of claim 5 wherein the mounting member is an arm and the vertex on each foot is elongated and substantially parallel with the arm.

7. The capo of claim 1 wherein at least two adjacent feet of the plurality of feet are slideably interlocked.

8. The capo of claim 1 wherein the plurality of feet are stationary relative to one another on the frame in a lateral direction, and wherein the plurality of feet include two medial feet and two lateral feet.

9. The capo of claim 8, wherein each foot is separated from an adjacent foot by a first distance, and wherein the two medial feet are separated by a second distance that is significantly greater than the first distance.

10. The capo of claim 8 wherein the two lateral feet are greater in width than the two medial feet.

11. The capo of claim 10 wherein the plurality of feet further include two intermediate feet, each intermediate foot positioned between a lateral foot and a medial foot, and wherein the two intermediate feet are substantially a same width as the two medial feet.

12. The capo of claim 11 wherein the lateral feet are about 0.40 inches in width and the medial feet and intermediate feet are about 0.30 inches in width.

13. A capo comprising:

a frame;

a plurality of individually selectable toggle members retained by the frame; and a plurality of feet provided on the toggle members, each foot separated from an adjacent foot by a distance in a lateral direction, each of the feet fixed relative to one another in the lateral direction, wherein the distance between two first adjacent feet is different than a distance between two second adjacent feet, wherein the feet have differing widths, and wherein each foot includes a vertex directed away from the toggle members.

14. The capo of claim 13 wherein the two first adjacent feet have substantially a same width and the two second adjacent feet have substantially different widths.

15. The capo of claim 13 wherein the frame is a block and the toggle members are spring loaded plungers retained in holes in the block.

16. A capo configured for use with a stringed instrument including a plurality of strings, the capo comprising:

a block including a plurality of holes;

a plurality of plungers retained in the holes in the block, each plunger including a head end and a foot end, the head end designed and dimensioned to engage a human fingertip, the foot end configured to engage one of the plurality of strings of the stringed instrument, wherein each of the plungers is fixed in a lateral direction relative to an adjacent plunger, wherein each plunger is selectively moveable in an engagement direction between a retracted position and a depressed position, and wherein the foot ends of the plungers have differing lateral widths; and a plurality of locking mechanisms retained in the block, each locking mechanism associated with one of the plungers, wherein each plunger is configured to retain the associated toggle member in the depressed position when a first axial force on the plunger forces the plunger to a threshold position, and wherein each locking mechanism is configured to release the associated plunger from the depressed position when a second axial force is applied to the plunger.

17. The capo of claim 16 wherein the foot ends of the plungers are separated by lateral gaps of differing dimensions.

18. The capo of claim 16 wherein the plungers are spring loaded plungers.

19. The capo of claim 16 wherein the second axial force applied to the plunger forces the plunger to the threshold position.

20. The capo of claim 5 wherein the plurality of feet are stationary relative to one another on the frame in a lateral direction, wherein the plurality of feet include two medial feet and two lateral feet, wherein each medial foot is separated from one of the two lateral feet by a first distance, and wherein the two medial feet are separated by a second distance that is significantly greater than the first distance.

* * * * *